US005345613A

United States Patent [19]

Jones

[11] Patent Number: 5,345,613

[45] Date of Patent: Sep. 13, 1994

[54] WOMEN'S STOCKING AND SUPPORT

[76] Inventor: Alma M. Jones, RR1 Alliston, Ontario, Canada, L0M 1A0

[21] Appl. No.: 14,107

[22] Filed: Feb. 5, 1993

[51] Int. Cl.[5] ..... A41F 11/00; A41F 13/00

[52] U.S. Cl. ..... 2/240; 2/303; 2/340

[58] Field of Search ..... 2/240, 303, 335, 340, 2/409, 300, 321, 301, 322, 304, 305, 306, 307, 308, 309, 310, 311, 312, 313, 314, 315, 316, 317, 318, 319, 320; 450/29, 111

[56] References Cited

U.S. PATENT DOCUMENTS

| | | | |
|---|---|---|---|
| 1,362,556 | 12/1920 | Bettinger | 450/111 X |
| 1,803,214 | 4/1931 | Siegel | 2/335 |
| 1,924,433 | 8/1933 | Harpster | 2/240 |
| 2,364,636 | 12/1944 | Lang | 2/240 |
| 2,687,532 | 8/1954 | Menz et al. | 2/240 |
| 3,463,162 | 8/1969 | Heggie | 2/409 |
| 3,469,583 | 9/1969 | Gottlieb | 2/240 |
| 3,509,581 | 5/1970 | Lewis | 2/240 |
| 3,529,329 | 9/1970 | Burleson | 2/240 |
| 4,424,596 | 1/1984 | Jackson | 2/409 |
| 5,127,109 | 7/1992 | Heitzman-Powell et al. | 2/409 |

*Primary Examiner*—Jeanette E. Chapman
*Attorney, Agent, or Firm*—Malin, Haley, DiMaggio & Crosby

[57] ABSTRACT

This invention relates to an improved women's stocking and stocking support that utilizes a stocking support belt encircling the hip area of the wearer having only one stocking fastener on each side and a pair of normally cut (elongated to the wearer's crotch) individual stockings, each of which is made of a stretchable nylon material, each stocking having a single slit or fastener on the outside hip area so that the stockings may be held in place comfortably for long, extended wear on a single side fastener while remaining, because of the stretchability of the material, firmly and attractively in place between the crotch area of the wearer, the leg portions, and the hip areas. Other articles of clothing such as tank tops or bodysuits can also be used as support members for the stretchable hose.

7 Claims, 3 Drawing Sheets

WOMEN'S STOCKING AND SUPPORT

BACKGROUND OF THE INVENTION

1. Field of the Invention

This invention relates to an improvement in women's hosiery, and in particular, to improved women's sheer stockings and a support system for increased extended wear comfort and economical manufacture. The invention is comprised of individual spandex fiber, nylon or nylon-like fabric stockings, of crotch length, individually supported at a single side point in the hip area for stocking support to allow for extended wear comfort, while covering the leg areas, full length, up to the crotch and hip.

2. Description of the Prior Art

The use of sheer stockings by women, such as "nylons," has been well known for many years. Nylon itself is any of a family of high strength, resilient, synthetic materials, the long chain molecules of which contain a recurring amide group CONH. Cloth or thread can be described as nylon and it has various degrees of sheerness. At the present time, women's stockings can be made of nylon or a similar synthetic fabric and still be called nylons. Spandex fiber is very suitable for women's stockings.

For many years, women's sheer stockings have been supported by garter belts. The primary drawback of garter belts are that they include a plurality of rigid fasteners that could contact the leg and be uncomfortable to the wearer. Also, as dress lengths changed, the upper portions of hosiery, top bands could be unsightly, along with the garter belt fasteners. To eliminate these problems, pantyhose were created which use nylon or nylon-like fabrics with the leg stockings being combined with a panty in a unitary construction, eliminating the use of a garter belt to provide the support for the stockings. However, pantyhose can also be uncomfortable for the wearer, especially if worn over an extended period of time. Pantyhose also involves utilization of a single unitary garment so that if a run develops in one of the stocking legs, the entire garment must be thrown away. This is a costly waste of material. One of the advantages of pantyhose, however, was that as fashion changes and lengths of women's dresses changes, the stocking lengths went all the way up to the panty area and were therefore not visually unattractive.

In U.S. Pat. No. 5,027,441, ladies' stockings are shown with a support connected to the front, while the stockings are somewhat obliquely cut (at the opening) from the central axis so that each stocking is longer in the front than in the back. These stockings are expensive to manufacture. Also, they do not provide the proper dimensional length for support with all types of dress lengths and therefore suffer from the same problems as previous garter belt support systems. Also, when the wearer sits, the hose tend to pull down at the back of the leg, causing discomfort upon walking. U.S. Pat. No. 3,529,329, issued to Burleson on Sep. 22, 1970, shows a fastener that is used to connect ladies' hosiery to girdles or other forms of support garments. U.S. Pat. No. 4,424,596, issued to Jackson on Jan. 10, 1984, shows a therapeutic stocking structure with a belt structure that connects along the sides of stockings. U.S. Pat. No. 3,501,774, issued to Norman on Mar. 24, 1970, shows a combination of a girdle and garter connection to use for hosiery supports. U.S. Pat. No. 3,625,029, issued to Safrit et al. on Dec. 7, 1971, includes a discussion and use of a "elastic yarn," which means any yarn having an inherent capacity to elongate under tension and having an inherent tendency to contract from an elongated condition with a degree of power in contraction. Such yarns include rubber and spandex yarns, both bare and covered. U.S. Pat. No. 3,469,583 issued to Gottlieb on Sep. 30, 1969, shows a combination girdle/stocking that has a plurality of fasteners using either hooks or buttons for supporting the hose. U.S. Pat. No. 3,487,473, issued to Jahnsen on Jan. 6, 1970, shows a combination of hose and a panty garment that has fasteners wherein the hose are sufficient length to be pulled over the wearer's hips. U.S. Pat. No. 3,566,411 issued to Gordon on Mar. 2, 1971, again shows a combination of pantyhose and hose construction for connecting the hose to the panty garment using a plurality of fasteners. U.S. Pat. No. 3,516,266 shows a circular knit stocking with integral garter loops that are connected along the top of the stocking for attachment to a garter belt and fastener around its edges. U.S. Pat. No. 3,362,029 issued to Comerma on Jan. 9, 1968, shows ladies' seamless sheer stockings which are adapted to completely cover the legs of the wearer and include a support device on the upper ends for encircling the lower trunk portion of the body. U.S. Pat. No. 3,440,665 issued to Russell on Apr. 29, 1969, shows women's hosiery composed of a pair of hip high stockings with front and rear hook members for supporting the stockings.

A review of the prior art shows that, the fasteners and fastener locations when using a garter belt structure, still create discomfort, especially for an extended time period wear of the hosiery.

The primary purpose of the present invention is to overcome these problems, especially with either a garter belt or pantyhose, that cause extended wear discomfort without increasing manufacturing costs. In the present invention, two separate hosiery legs are removably attached to either a garter belt or other article of clothing at a single point on each side in the hip area only for support while utilizing elongated hosiery, each extending all the way up the legs on the inside to the crotch area with a normal opening cut. The stockings may be manufactured with two different yarns, either all nylon or a nylon and spandex combination which allows for stretch with memory. One of the primary advantages of the present invention by having a single support fastener on each side at the hip area with the stretchable material is that it allows the body freedom from tight clothing, the elimination of stress points, allowing the body to move while the hosiery stays in place. Sitting or kneeling stretches regular hose to 20% to 40% from the waist to the back of the knee, resulting in sagging, yet pinching toes. With the present invention, there is no fabric across the body torso so that each hose can stay in place. From an economical standpoint, the extra material used in pantyhose is eliminated, while if a run develops in one of the stockings, you need only change one hose. By placement of the support system and the stretchability with memory of the hose themselves, the actual hose can be constructed and look completely normal as long stockings with a normal looking top that is not cut at an extreme, oblique angle relative to the central axis of the stocking. This allows for standard machinery for manufacturing the hose without additional sewing at the top of the garment. For example, as shown in U.S. Pat. No. 5,027,441 issued to Wilson on Jul. 2, 1991, the tops of the stockings are triangularly shaped and obliquely cut relative to the central longitudinal axis of the hose, again requiring additional expense and custom machinery.

The present invention envisions fabric of denier 10–70, preferably 10–20, with the stretchability of nylon or nylon and spandex material, sized in length to reach the crotch of the wearer while sufficiently stretchable on the outside (hip side) for stretchable support by a single fastener on each side near the hip area. Each side can be attached to either a garter belt or article of clothing to support the hose on the outside. Each stocking has a normal cut at the top opening and including a slot or hook on the outside to connect to the garter belt. Thus, the problems presented in prior ladies' stockings and hosiery support with fasteners that are positioned at different locations around each leg which are either unsightly with short dresses and provide pressure discomfort are eliminated. Since the stockings stretch all the way up the leg, the length of the woman's dress does not provide for unsightly situations even though a garter-like belt (only one fastener on each hip) is being used.

In lieu of the garter-like belt itself, the hose can be used with a body suit or a crop top where the hose are attached to each hip side.

SUMMARY OF THE INVENTION

This invention comprises full length women's stockings made of a stretchable material such as nylon or nylon and a spandex yarn, sized in length to reach the full length of a woman's leg measured from the leg inside up to the crotch, each stocking having a conventional cut opening in combination with a support device such as a stocking support belt that has one single fastener for each stocking in the hip area of the wearer to support each stocking. The outside stocking area is stretched in the hip area to engage the stocking with the support belt fastener. Each stocking has a conventional yet elongated overall configuration so that it can fit on either leg and has a normal edge and shape along the top opening that in effect is perpendicular to the longitudinal axis of the primary portion of the stocking body. The top edge opening of each stocking includes a very small elastic cuff that is sewn at the top annularly around the opening. The narrow cuff or band allows the elongated stocking to be sheer up to the cuff and is used to hold the very top opening of the stocking close to the body since the body of the stocking is made of a stretchable fabric and receive a fastener slit.

The support belt for each stocking is comprised of an elastic belt (which is the garter belt) having its own conventional buckle or fastener and two small, lightweight fasteners such as small hooks, one at each waist hip point, on each side. The outside top area of the stocking that would engage the outside torso portion near the hip includes a fastener receiver such as a reinforced slit or opening to receive the hook that is attached to the garter belt.

Of strategic importance in the operation of the invention is the elongated length of the stocking, and the natural stretchability and memory of the fabric material used in the hose body, such as nylon or nylon and spandex yarn, which allows the hose to stretch on the outside of the leg near the hip area while remaining close and comfortable up to the crotch area on the inside of the leg so that no extended garters are employed. Traditional garters hang several inches from the belt. Applicant has found that using a nylon or nylon and spandex stretch-like material for the stocking body in conjunction with the small elastic area around the top and a single fastener on each side of the body area in the hip area allows for full length stockings which are sized to reach from the crotch area on the inside of the leg to the heel to be comfortably worn as a full length stocking without the cutting of the stockings' top opening on an angle for attachment in the hip area.

The construction of the stocking body is conventional except elongated for the wearer to the crotch with a small top band (elastic-like) and a fastener to engage the single fastener on the support garment. Each stocking can use conventional machines while constructing the hose except for the particular type of fastener affixed to the hose body. Extra material is not wasted by having angular or V-shaped portions of the top opening of the hose. Instead, the stocking opening is normal in construction and therefore, very economical in terms of the manufacture of the hose.

As a supplemental stocking support system, crop tops, tank tops, or body suits could be utilized with the particular stockings, each of which the top or body suit would include an outside hook fastener in the hip area that attaches to the outside area of the hose as described. The stocking stretches upward on the outside but with memory so that each hose body itself along the upper opening surrounds the leg from the inside crotch area upwardly to the hip area, resulting in a full length stocking on each side of the wearer. It has been determined that the utilization of the present invention is extremely comfortable, especially for extended wear (a full working day), and the support fasteners are undetectable because the two fasteners are so small and lightweight, only one each side, in unobservable location. The stockings remain full length of the legs regardless of the dress length being utilized by the wearer, permitting very short skirts. The lock of the hook fastening the hose to the belt is at the hip, in close proximity to the hip joint, thus allowing the hose to move in natural harmony with leg movement and therefore minimizing (even eliminating) the tension that is normally increased with sitting or kneeling when wearing traditional garter belts or pantyhose.

As the invention is envisioned, each hose is of an elongated length compared with mid-length hose sizes, with the invention using hose that reach up to the crotch area and which will be sold in various sizes, perhaps five, for different sized women.

One of the important features of this invention is that each stocking or hose is completely separate from each other and from the belt. Thus, the size of the hose worn is independent from the size of the waist. Since there is no physiological consistent relationship between an individual size of hose, the size of the leg, and the size of the waist, this unique configuration gives an individual the freedom to select the best combination. For example, the hose size can be selected completely independent of the belt size. Any type of one piece design such as pantyhose must compromise, minimizing comfort of the article.

Another advantage of this invention is that it enables the wearer to sit while putting on hose, an important point for those with balance problems, which is not available with pantyhose. It is believed that the configuration of support and elongated hose, as disclosed in the invention, are healthier for the body than pantyhose because of the overall circulation provided and comfort level. From an aesthetic viewpoint, the present invention can use stockings that are sheer all the way to the waist or inside crotch area, which requires no specific or elongated reinforcement areas except for a very small top cuff edge of approximately ¼ to ½. Many conventional stockings include very wide, several inch bands of reinforced area which destroy the sheer look and add additional discomfort.

It is an object of this invention to provide improved women's hosiery and support which include independent full length sheer stockings made of a nylon and nylon and spandex stretchable material to provide extended wear comfort to the user.

It is another object of this invention to provide a pair of sheer stockings supported by a unique belt or similar support that insures full length stockings without the discomfort of conventional garter belt fasteners on different areas of the leg.

It is another object of this invention to provide a pair of women's stockings that is supported to allow the body freedom from tight clothing, allows for sitting or kneeling stretching without sagging in complete extended wear comfort.

It is another object of this invention to provide an improved women's hosiery and full length stocking support for comfort and to eliminate unsightly garter belt or hose tops when using short clothing or clothing that exposes leg portions, each stocking including a single fastener along the waist while remaining a normal cut for manufacturing purposes.

But yet still another object of this invention is to provide women's sheer stockings which are comfortable for extended wear and which are economical to produce, having a normal top configuration.

In accordance with these and other objects which will be apparent hereinafter, the instant invention will now become described with particular reference to the accompanying drawings.

DESCRIPTION OF THE PREFERRED EMBODIMENTS

Figure 1:
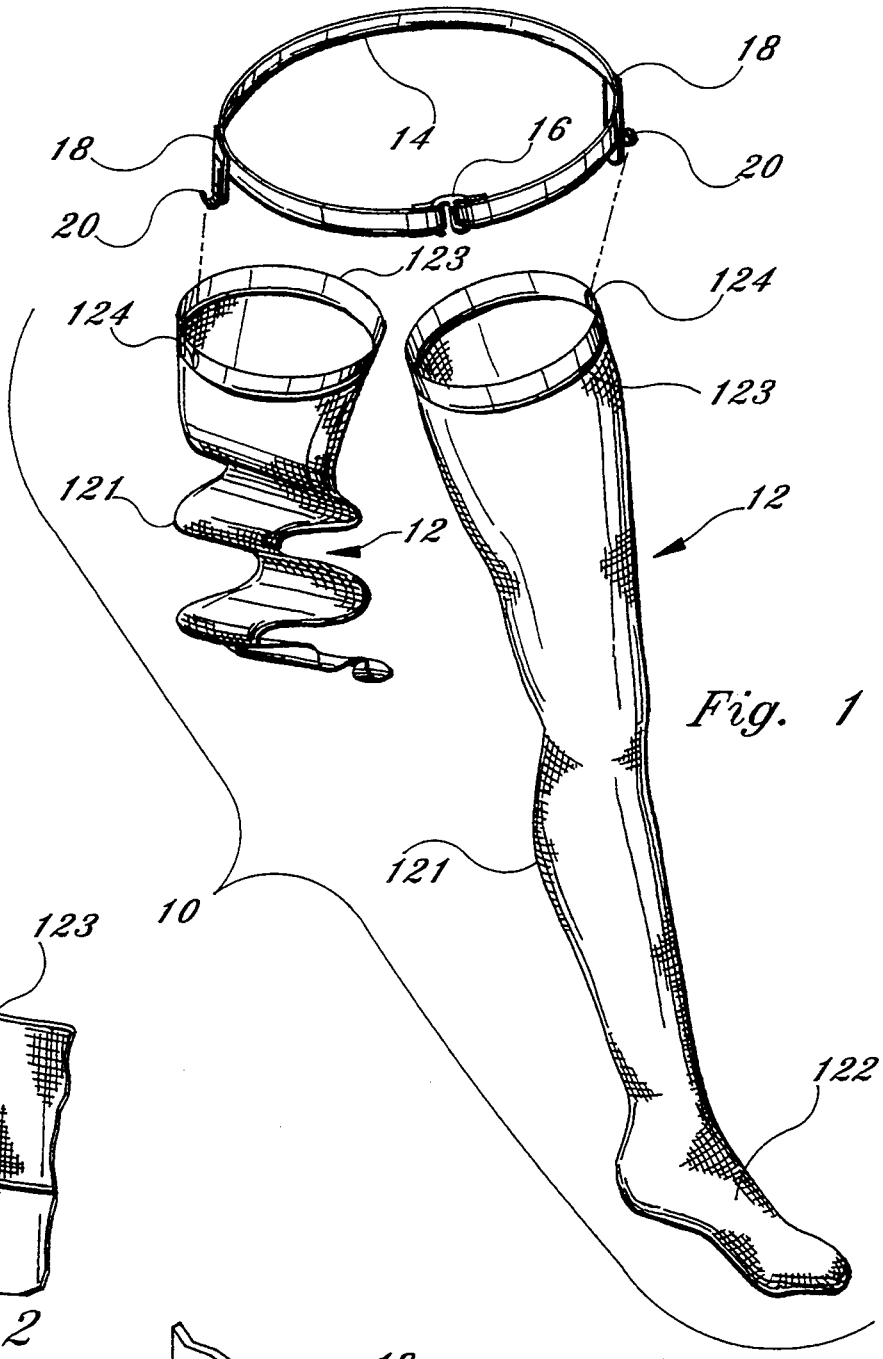
FIG. 1 shows a perspective view of the present invention in which one stocking is fully extended as if a leg were in it and another stocking is folded in conjunction with a garter belt support shown as if it were worn by a person.

Referring now to the drawings, and in particular FIG. 1, the present invention is shown generally at 10, comprised of an elastic waist-encircling stocking support belt 14 having a waist fastener 16 for encircling and connecting the belt around the wearer's waist. The belt 14 has a pair of hook fasteners 20, one each attached diametrically opposed, which represents the hip area of the wearer. A very short fastening strip 18 may be utilized to connect the hooks 20 and the belt. The strip 18 may be made of a conventional fabric and may be quite short, such as one inch.

A pair of individual leg-encircling stockings 12, elongated to reach the wearer's crotch, are shown, each having a small reinforced slit 124 as part of the top band 123 used to surround the opening of the stocking. The hosiery body 121 is comprised of a nylon fabric with spandex that is stretchable and yet has memory so that it returns to its normal shape. The reinforced opening 123 could also be a slight elastic band. As shown in FIG. 1, the normal opening 123 of each stocking is conventional, as is the entire shape of the stocking body 12 in all respects. It is preferred to be made, however, of a stretchable nylon or nylon and spandex material for the purposes of this invention. However, nylon can be used since it has some stretchability and memory, or other nylon-like materials.

Figure 2:
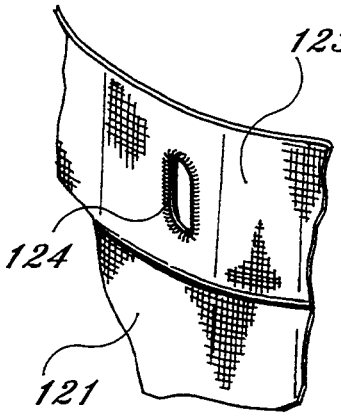
FIG. 2 shows a cutaway, perspective view of one upper portion of a hose fastener.

Referring to FIG. 2, the single upper band 123 defining the opening of the stocking, shows a reinforced slit 124 that receives a single hook 20 that is basically connected to belt 14 in the hip area. This is the only and single support of the entire stocking on one leg. However, because of the stretchability of the stocking material, the stocking will be sized in length to fit from the inside crotch of the wearer while stretching on the outside hip area when in use. The outside stretch area is not severe or extreme enough to overtax the memory of the fabric or cause discomfort. Note that the belt fastener is at the hip area and is completely unobservable regardless of the length of any short skirt being worn. Also, the fastener 20 is disposed in an area where there can be no discomfort in sitting to the wearer.

Figure 2A:
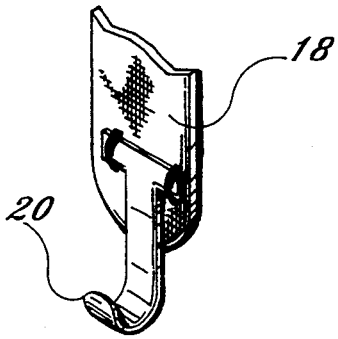
FIG. 2A shows a perspective, cutaway view of a hook fastener used with the present invention.
Figure 2B:
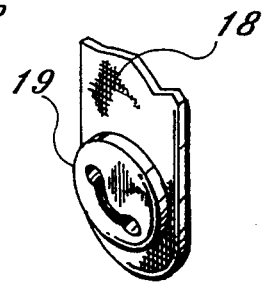
FIG. 2B shows a perspective, cutaway view of a button that can be used with the present invention.

FIG. 2A shows a fastener 20 attached to the fabric band 18 by thread or other conventional means. It is a lightweight plastic or metal hook 20 that is used.

In an alternate embodiment, the fastener could be used as a button 19 sewn to fabric strip 18 that is attached to belt 14 and fits through slot 124 as shown in FIG. 2.

Figure 3:
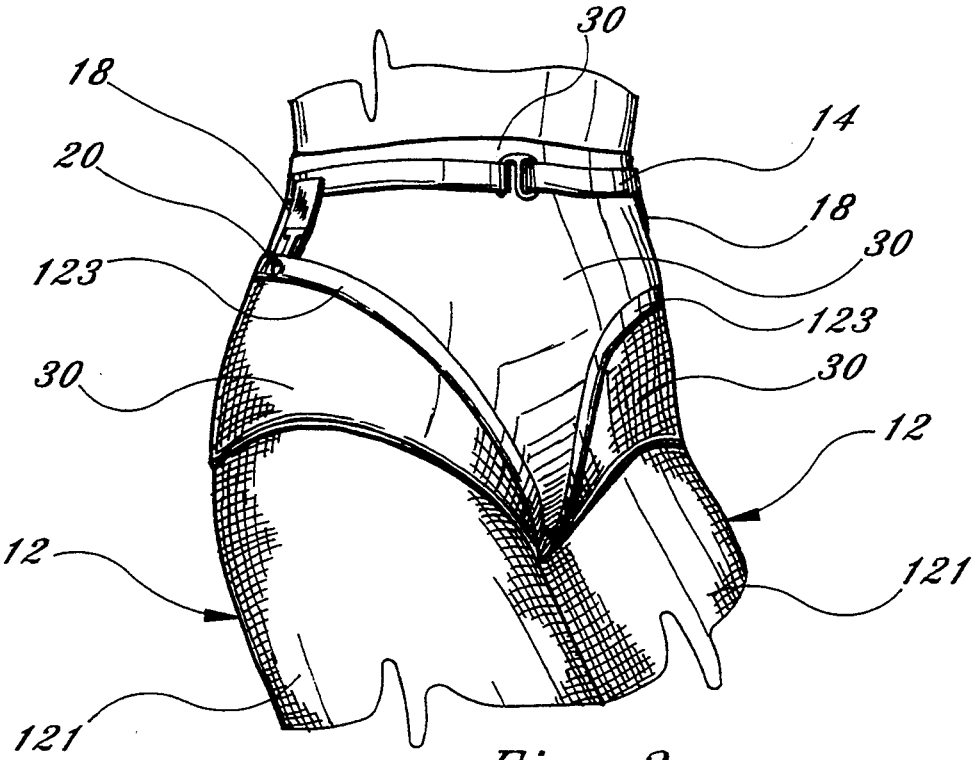
FIG. 3 shows a perspective, front view of the present invention as used on the torso of a person.

Referring now to FIG. 3, the invention is shown as would be in use with the belt 14 encompassing the torso of the wearer who could also be wearing a pair of underpants 30. The fasteners 20 are connected through the appropriate slot on each side extending through the stocking opening 123, which as you can see from FIG. 3, extends much higher up the hip area than the inside portion along the inner crotch area. This is because the body of the stocking 12, comprised of fabric 121, is stretchable and extends up on the side portions while remaining comfortable throughout the entire leg area. Note that the fastener 20 is completely disposed in the hip area only, with no other fasteners impeding the use of the garment.

Figure 4:
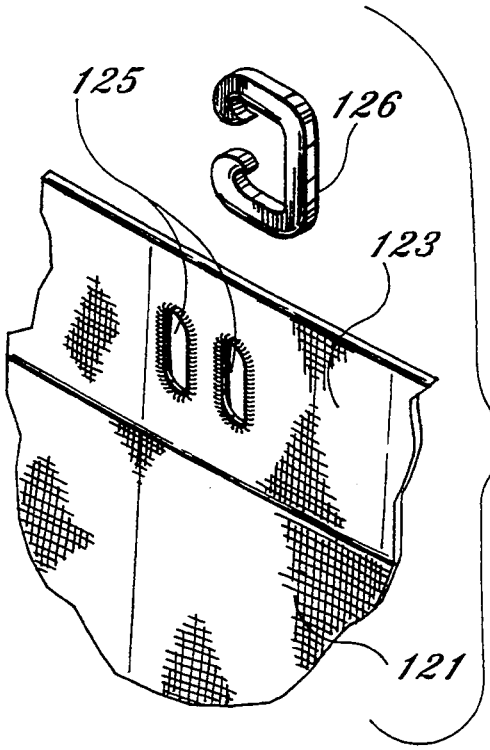
FIG. 4 shows an alternate fastening means partially cutaway in perspective which utilizes a support clamp in conjunction with a pair of slots disposed on the upper portion of the hose.

FIG. 4 shows an alternate fastener 126 which may be a C-shaped hook that could attach both to belt 14 and through a pair of slots 125 disposed in the upper elastic band area 123, representing the opening of each stocking with stocking body 121 attached thereto. Various shapes of hooks may of course be employed.

Figure 2C:
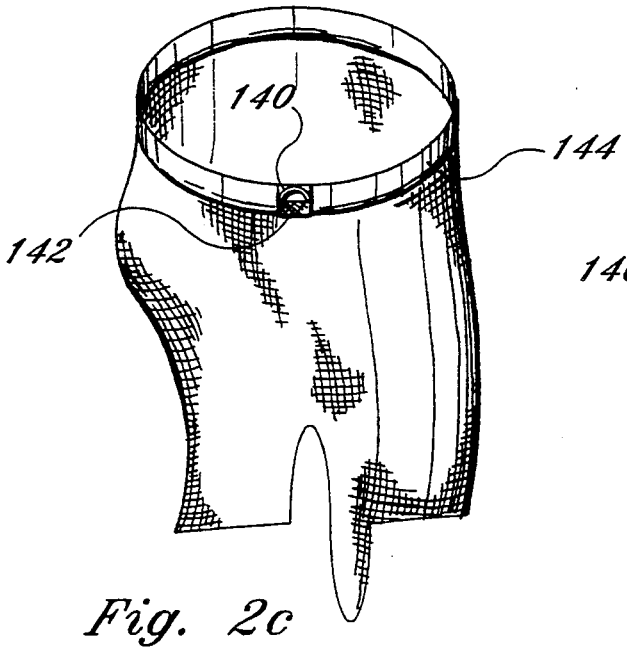
FIGS. 2C and 2D show an alternate fastening embodiment used with the present invention.
Figure 2D:
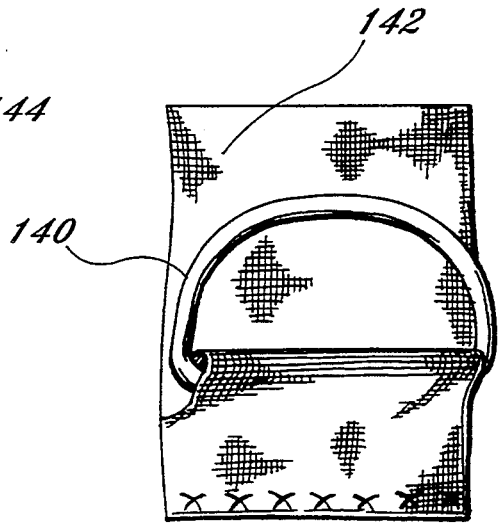

FIG. 2C and 2CC show another type of receiving fastener on the top of the stocking 144. A small fabric patch 142 may be attached to the upper edge of the stocking and includes a reinforced loop of a string-like or fabric material 140 that itself receives a button or a hook as previously discussed. FIG. 2CC shows how the fabric patch 142 is attached to a loop 140 where it can be stitched along one single edge on the outside hip area of the stocking. This would, of course, replace the slits previously shown for receiving the hook or button.

Figure 5:
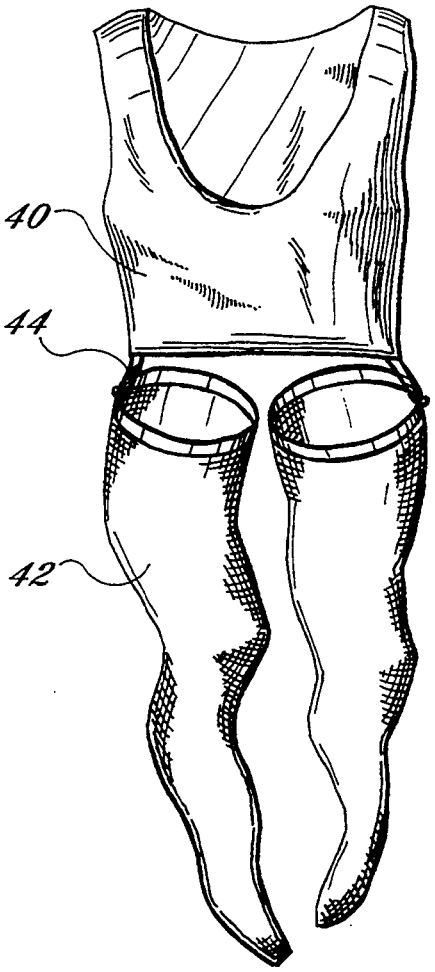
FIG. 5 shows a front schematic view of an alternate embodiment of the invention.

FIG. 5 shows an alternate embodiment of the invention, wherein a woman's upper body garment, such as a tank top 50, could include a single fastener 44 on each outside hip area that allows for similar attachment to a pair of stockings 42 as discussed throughout the invention. This would replace and alleviate the use of the previously shown belt for surrounding the waist while the hooks or fasteners 44 would be attached to both the tank top 40 and with a slit as shown in each stocking 42.

Figure 6:
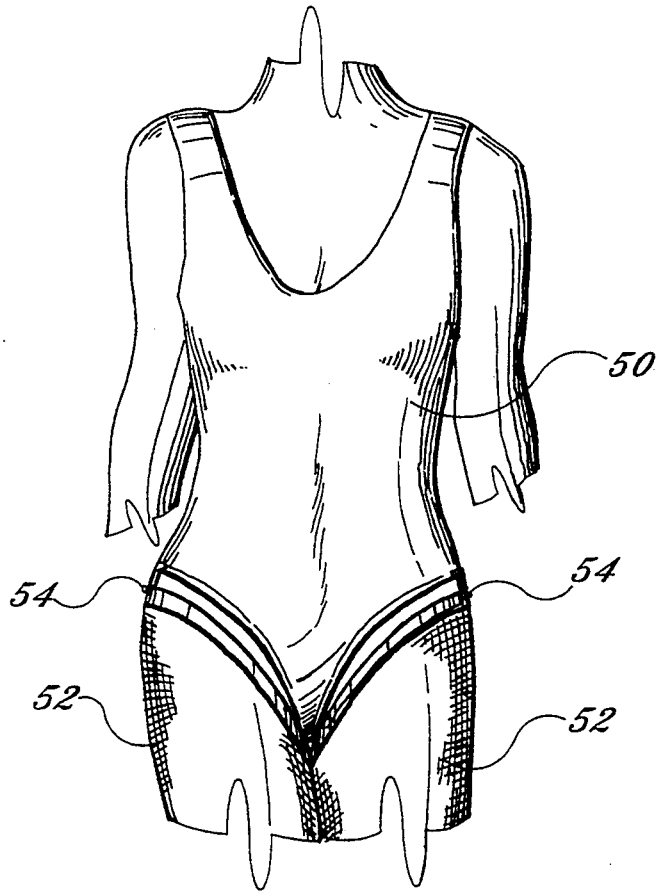
FIG. 6 shows another alternate embodiment of the present invention in a front schematic view.

FIG. 6 shows a full body stocking 50, which itself could have fasteners 54 that are used to attach it to stockings on each side as has been discussed throughout, either with hooks, buttons, and slits, or with the fabric hook as discussed. Again, the stockings used herein are of a normal configuration and will not require any alteration in the equipment for manufacturing the stockings. The use of spandex fibers will provide for great stretch action, allowing the hip area to be drawn up to the fastener with the other area remaining comfortably in the crotch area.

All of the hose and support garments as shown provide for extended longer comfort throughout the day without intrusion by fasteners on the leg areas which can cause discomfort and without the discomfort of wearing tight pantyhose for long periods of time. The stocking configuration, although elongated, is cut normal and does not require extensive or expensive modification of equipment for manufacturing the hose garments.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A women's stocking and support, comprising:

a pair of full length stockings made of a stretchable material, each stocking having only a single fastening means disposed only at a single point along its upper edge for attaching to another fastener; and a belt for support and for encircling a wearer's torso, said belt having only two fasteners, one fastener on each respective hip area, each belt fastener is detachable, attached to said single a corresponding fastening means of said stocking, allowing the stocking to be stretched full length between the foot and the inner crotch and between the inner crotch and the outside hip area of the wearer said stocking thereby being held firmly and comfortably with a single attachment point disposed at the hip area of the wearer.

2. A woman's stocking and support as in claim 1, including:

said full length stockings being made substantially of a sheer material, stretchable with memory, such as nylon.

3. A woman's stocking and support as in claim 1, wherein:

said full length stockings are made of a sheer, stretchable material that includes a spandex material.

4. A woman's stocking and support as in claim 1, wherein said stocking fastening means includes a reinforced slit and said belt includes a hook, said hook sized to fit within said slit.

5. A woman's stocking and support as in claim 1, wherein:

said single fastening means includes a small fabric loop attached to a topmost edge of the stocking on each side in the hip area, and said belt fasteners are hooks.

6. A woman's stocking and support as in claim 1, wherein:

said stocking fastening means includes at least two parallel slits, and said belt fasteners include hooks each having an arm portion that can extend through both slits in said stocking.

7. A woman's stocking and support as in claim 1, wherein:

a top portion of said pair of stockings includes a narrow cuff portion for attachment of said fastening means; and further wherein said fastener attached to said belt is a hook-like mechanism.

* * * * *